United States Patent [19]

Armstrong

[11] 4,239,135

[45] Dec. 16, 1980

[54] MULTIPURPOSE RUCKSACK

[76] Inventor: Francis T. Armstrong, 67 Station Rd., Banchory, Kincardineshire, Scotland

[21] Appl. No.: 66,293

[22] Filed: Aug. 13, 1979

[51] Int. Cl.[3] ..... A47G 9/00

[52] U.S. Cl. ..... 224/154

[58] Field of Search ..... 224/154, 153, 156

[56] References Cited

U.S. PATENT DOCUMENTS

| | | | |
|---|---|---|---|
| 39,150 | 7/1863 | Joubert | 224/154 |
| 1,198,773 | 9/1916 | Robinson | 224/154 |
| 3,923,217 | 12/1975 | Dean et al. | 224/154 |
| 3,931,918 | 1/1976 | Smith et al. | 224/154 |
| 4,035,855 | 7/1977 | Kim | 224/154 X |

*Primary Examiner*—Steven M. Pollard

*Attorney, Agent, or Firm*—Mason, Fenwick & Lawrence

[57] ABSTRACT

A multipurpose rucksack can be opened out into the shape of an elongate rectangle and has an inner lining from which a tent can be erected when the rucksack is opened out with the aid of spacer bars. Conveniently, the rucksack has a pocket to fit over a frame which can be strapped to a wearer and means for receiving the spacer bars whereby the spacer bars can be carried with the rucksack on the frame.

1 Claim, 5 Drawing Figures

MULTIPURPOSE RUCKSACK

DESCRIPTION

This invention relates to a multipurpose rucksack.

An object of the invention is to provide a rucksack which can both carry a wearer's equipment and also provide a temporary form of habitation for the wearer.

According to the invention there is provided a multipurpose rucksack which can be opened out and which is provided with an inner lining from which a tent can be erected when the rucksack is opened out.

An embodiment of the invention will now be described by way of example, with reference to the accompanying drawing, in which.

Figures 1, 2:
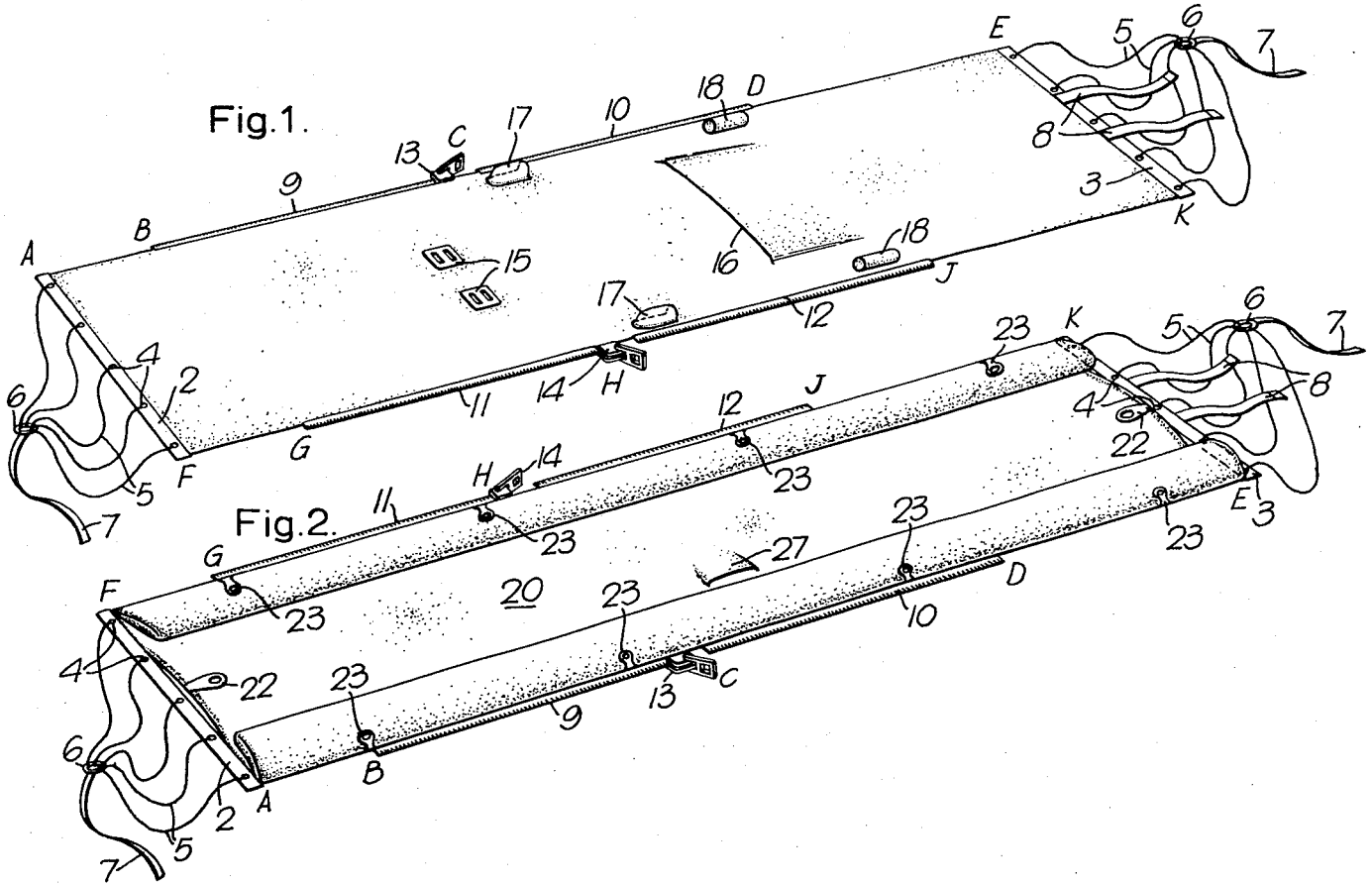
FIG. 1 is a perspective view of a multipurpose rucksack completely opened out and laid on a flat surface with the outer surface of the rucksack uppermost.
FIG. 2 shows the same as FIG. 1 but with the outer surface of the rucksack lowermost.

In FIG. 1 an outer surface 1 is in the shape of an elongate rectangle at the end of which are reinforced margins 2 and 3 each having five spaced apart eye holes 4 from which hang cords 5 extend to a ring 6 to which is attached a length of stout rope 7. Two straps 8 are attached to the margin 3. The surface 1 may be considered as being divided into four areas identified by the letters ABGF, BCHG, CDJH, DEKJ. Along the portions BC, CD, GH and HJ of the sides of the surface 1 are separate lengths of the toothed components 9, 10, 11, 12 of sliding clasp fasteners, the sliding clasps of which are shown at 13, 14.

Within the area BCHG near the imaginary line CH there are attached two buckles 15 for receiving the straps 8. Within the area CDJH is a pocket 16 to fit over a frame (not shown) which can be strapped to a wearer to enable the rucksack, when closed, to be carried on the back of the wearer. Also within the area CDJH and near each of the portions CD and HJ is a small pocket 17 and a short tube 18 for carrying a spacer bar 19 (see FIGS. 4 and 5) to be described later.

Figures 3, 4, 5:
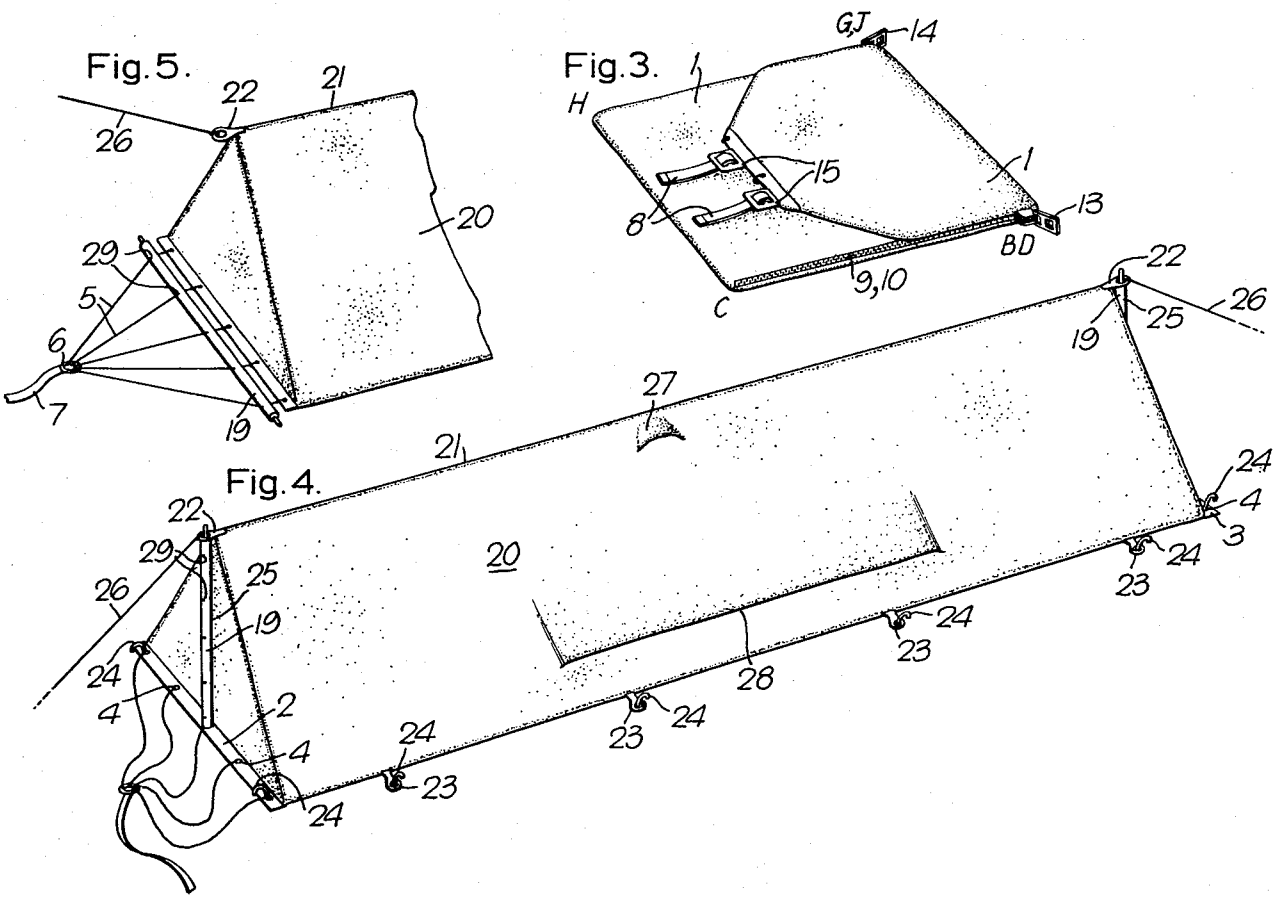
FIG. 3 is a perspective view of the rucksack closed.
FIG. 4 is a perspective view similar to FIG. 2 but with inner lining of the rucksack erected into the form of a tent pitched on the ground.
FIG. 5 is a fragmentary view of the erected tent of FIG. 4 as it would appear when slung clear of the ground between two spaced apart supports.

Referring now to FIG. 2, there is shown a lining 20 flattened and folded but which can be erected into the form of a tent having a ridge 21 (see FIGS. 4 and 5). At each end of the ridge 21 is provided an eyeletted tab 22 shown folded inwards. Furthermore, four spaced apart eyeletted tabs 23 are provided along each side of the surface 1 and these are also shown folded inwards.

In order to form the closed rucksack shown in FIG. 3 from the opened-out rucksack shown in FIG. 2 the items 5, 6, 7 are folded inwards from the end margins 2 and 3. The area ABGF is then folded inwards on the imaginary line BG so that the area ABGF forms a flap overlying the area BCHG. The area BCHG, together with the flap ABGF, is then folded on the imaginary line CH as to overlie the area CDJH. The sliding clasp fasteners 9, 10, 13 and 11, 12, 14 are then closed to form a bag. The corners E and K of area DEKJ are then folded over and, in this form, the area DEKJ is folded on imaginary line DJ to overlie the bag and finally the straps 8 are pulled through the buckles 15 to close the bag. The rucksack in FIG. 3 is empty for illustrative purposes. Clothes and other equipment can be placed in a plastic bag which can in turn be placed in the rucksack. The loaded rucksack can then be placed on a conventional rigid frame (not shown) provided with straps for securing the frame to the back of a wearer. The top of the frame is slipped into the pocket 16 and the loaded rucksack is also cradled by the frame.

Starting again from the situation shown in FIG. 2 with a view to pitching the tent, shown in FIG. 4, on the ground, the eyelet tabs 23 are folded out and skewers 24 are forced into the ground through the eye holes. Skewers 24 are also forced into the ground through the end eye holes 4 in the margins 2 and 3. In order to erect the tent two spacer bars 25 are provided. One pointed end of each spacer bar 25 is inserted from below through the eye hole in each tab 22 while the other end of each spacer bar 25 is inserted through the middle eye hole 4 in each of the margins 2 and 3. Finally, guy ropes 26 are fastened to the tabs 22, skewered to the ground and tightened. In FIG. 4 there is shown in the lining 20, from which the tent is erected, a hooded ventilation opening 27 and a hooded access opening 28 which is provided with a sliding clasp fastener.

As illustrated, the erected tent is essentially in the form of a triangular section prism, with the sides of roof joining, at their extreme edges, side edges of a floor and sloping edges of end walls. It is alternatively envisaged that the erected tent also has shallow side walls and that the extreme edges of the roof extend beyond the end and side walls.

Instead of pitching the tent on the ground as shown in FIG. 4 it can be hung in the manner of a hammock clear of the ground between the two spaced apart supports, e.g. trees, in the manner shown fragmentarily in FIG. 5. In this case, the spacer bars 25 which are provided with spaced apart slots 29 are used to maintain the margins 2 and 3 in a substantially straight condition by inserting the cords 5 near the margins 2 and 3 into the slots 29. The weight of the hanging tent and its occupant are taken by the stout ropes 7 and the tent is maintained erected by the guy ropes 26, the ropes 7 and 26 being attached to the spaced apart supports. Advantageously, the guy ropes 7 include strong elastic sections to maintain tension in the ridge 21.

The spacer bars shown in FIGS. 4 and 5 may be conveniently carried on the loaded rucksack in the items 17 and 18 shown in FIG. 1. Alternatively, both spacer bars may be carried on one side of the rucksack.

Instead of erecting the tent as shown in FIG. 4 or 5, the multipurpose rucksack can be used simply as a survival bag into which the user can crawl and shelter from blizzard or rain.

I claim:

1. A multipurpose rucksack comprising an outer surface which has an inner lining which can be erected into the form of a tent having a ridge with the outer surface as the undersurface of the tent, the outer surface having a pocket to fit over a conventional frame which can be strapped to a wearer and also having means for receiving spacer bars for supporting the erected tent, reinforced margins at the ends of the outer surface, a plurality of cords attached at spaced apart locations along each margin and joined to a length of stout rope, and two spacer bars each provided with spaced apart slots, the spacer bars being alternatively useable with guy ropes to support the ends of the ridge when the tent is pitched on the ground and with the cords inserted in the slots to maintain the margins in a substantially straight condition when the tent is hung by means of the stout ropes in the manner of a hammock clear of the ground between two spaced apart supports and the ends of the ridge are supported simply by guy ropes.

* * * * *